US005862525A

United States Patent [19]

Tankersley et al.

[11] Patent Number: 5,862,525

[45] Date of Patent: Jan. 26, 1999

[54] FOLDED SURGICAL GOWN FOR ASEPTIC DONNING, APPARATUS AND METHOD FOR PRODUCING SAME

[75] Inventors: Terry N. Tankersley, LaGrange; Stephen G. Will, Marietta; Richard A. Willett, Loganville, all of Ga.

[73] Assignee: Kimberly-Clark Worldwide, Inc., Neenah, Wis.

[21] Appl. No.: 827,920

[22] Filed: Apr. 8, 1997

[51] Int. Cl.[6] ..... A41D 13/00; A41D 27/00

[52] U.S. Cl. ..... 2/243.1; 2/83; 2/114; 2/105; 2/115

[58] Field of Search ..... 2/1, 455, 457, 2/46, 48, 49.1, 49.2, 49.3, 49.4, 49.5, 50, 51, 52, 69, 69.5, 70, 71, 74, 81, 82, 83, 84, 85, 86, 87, 88, 89, 93, 94, 105, 106, 104, 113, 114, 115, 901, 912, 913, 914

[56] References Cited

U.S. PATENT DOCUMENTS

| | | |
|---|---|---|
| 3,359,569 | 12/1967 | Rotanz et al. . |
| 3,570,012 | 3/1971 | Winters . |
| 3,721,999 | 3/1973 | Goya et al. . |
| 4,523,335 | 6/1985 | Scrivens . |
| 4,783,854 | 11/1988 | Bjökklund . |
| 5,074,444 | 12/1991 | Cooper . |
| 5,097,534 | 3/1992 | Viemeister et al. . |

FOREIGN PATENT DOCUMENTS

| | | |
|---|---|---|
| 0301475 A1 | 1/1989 | European Pat. Off. . |
| 0677610 A3 | 10/1995 | European Pat. Off. . |
| 2329219 | 5/1977 | France . |

OTHER PUBLICATIONS

Copy of International Search Report for corresponding PCT application, dated Aug. 18, 1998.

U.S. Ser. No. 895,506, Willett et al., filed Jul. 16, 1997.

"Universal 1500 Textile Folder," by Southland Equipment Co., Inc., Loganville, Georgia.

*Primary Examiner*—Jeanette E. Chapman

*Attorney, Agent, or Firm*—Dority & Manning, P.A.

[57] ABSTRACT

A surgical gown in an improved folded arrangement, as well as methods and apparatus for producing same. Like prior art book-folds, the folded arrangement includes left and right hand pockets to facilitate aseptic donning by a medical professional. Unlike prior art book-folds, however the folded arrangement of the invention employs a unique fold sequence particularly amenable to automated processing. Methods of the invention are directed to the specific fold sequences that can be utilized to produce the folded arrangement. Apparatus for producing the folded arrangement includes a number of operative sections functionally arranged in series.

18 Claims, 15 Drawing Sheets

FOLDED SURGICAL GOWN FOR ASEPTIC DONNING, APPARATUS AND METHOD FOR PRODUCING SAME

BACKGROUND OF THE INVENTION

The present invention relates generally to the art of surgical gowns and the like folded for aseptic donning. More particularly, the invention relates to an improved folded surgical gown, as well as improved apparatus and methodology for producing same.

Generally, surgeons and other medical professionals will wear an overgarment during operating procedures both to enhance the sterile condition in the operating room and to protect the underclothes of the wearer. The overgarment is typically configured as a gown having a main body portion to which respective sleeves are attached. According to modern practice, the gowns are often made from a breathable nonwoven barrier material and are intended to be disposable.

Surgical gowns of this type are often packaged and presented to the wearer in a "book-fold" arrangement. In such an arrangement, exterior surfaces of the gown are contained largely inside the folded garment. Hand pockets are located on each side of the folded garment for receipt of the wearer's respective hands. As the hands are lifted up and out, the gown will unfold and fall into place on the wearer's body.

A known process for producing a folded surgical gown having a book-fold arrangement is disclosed in U.S. Pat. No. 3,359,569 to Rotanz et al. According to this technique, the gown is folded upward a plurality of times and the sleeves are folded in half. Final folds are made by folding the gown inward a number of times until the gown resembles the shape of a book. Hand pockets are formed on opposite sides of the gown to enable aseptic donning in the manner described above.

While the technique shown in Rotanz is effective at producing a folded surgical gown for aseptic donning, it is not without disadvantages. Notably, the fold sequence is difficult to replicate on automated equipment. As a result, manual labor, with its inherent costs and other inefficiencies, has generally been used to produce the folded garment.

SUMMARY OF THE INVENTION

The present invention recognizes and addresses the foregoing disadvantages, and others, of prior art constructions and methods. Accordingly, it is an object of the present invention to produce a surgical gown in an improved folded arrangement.

It is a further object of the present invention to produce a surgical gown in an improved folded arrangement which also has opposed hand pockets for aseptic donning.

It is a further object of the present invention to produce a surgical gown in an improved folded arrangement that can be efficiently produced utilizing automated equipment.

It is also an object of the present invention to provide improved methodology for producing a folded surgical gown.

It is also an object of the present invention to provide apparatus for producing a folded surgical gown.

Some of these objects are achieved by a surgical gown comprising a main gown configured to cover a predetermined area of a wearer's body. The main gown includes a back portion, and an opposed front portion having respective left and right flaps. Left and right sleeves are attached to the main gown to extend from respective lateral sides thereof.

The surgical gown is folded in a manner in which each flap is turned at least partially back upon itself to expose an interior surface of the main gown. The sleeves are each folded behind the back portion of the main gown. The main gown is also back folded along first and second longitudinal fold lines extending substantially parallel to the lateral sides thereof. In addition, the main gown is back folded after folding along the longitudinal fold lines along at least one transverse fold line substantially transverse to the lateral sides of the main gown to define left and right hand pockets. The main gown is further folded along a third longitudinal fold line to form a folded surgical gown such that respective hand pockets are located on opposite sides thereof.

In exemplary embodiments, the main gown is back folded along first and second transverse fold lines after being back folded along the first and second longitudinal fold lines. Preferably, the main gown is further back folded along an initial transverse fold line before being back folded along the first and second longitudinal fold lines. For example, the section of the main gown folded along the initial transverse fold line may have a longitudinal length of between one-fourth and one-half the initial longitudinal length. The resulting longitudinal length may then be folded into thirds along the first and second transverse fold lines, thereby yielding a longitudinal length less than one-fourth the original longitudinal length of the main gown. In addition, the sleeves may be folded behind the back portion of the main gown before the main gown is folded along the initial transverse fold line.

The sleeves of the surgical gown are preferably folded behind the back portion of the main gown at an acute angle from a transverse dimension of the main gown. For example, the sleeves may each be folded in at the lateral sides of the main gown to completely cross one another behind the back portion of the main gown. Alternatively, the sleeves may each be folded in at the lateral sides of the main gown and out at an intermediate location thereof back toward the lateral sides.

Other objects of the invention are achieved by an apparatus for folding a garment having a main gown to which left and right sleeves are attached and comprising a plurality of operative sections arranged in series. In particular, the apparatus includes an infeed section having a platen surface adapted to horizontally support the main gown of the garment such that the sleeves hang vertically therefrom. A sleeve-tucking section is provided, operative to fold the sleeves behind a back portion of the main gown. A longitudinal folding section is operative to fold the main gown along first and second longitudinal fold lines to thereby decrease a transverse width of the garment. A transverse folding section, preferably operatively succeeding the longitudinal folding section, folds the main gown along at least one transverse fold line to form a folded garment.

In exemplary embodiments, the apparatus includes a support element, located at an output of the transverse folding section, to which the garment is delivered. The support element preferably includes a longitudinal folding bar about which a manual longitudinal fold may be made.

The transverse folding section is preferably operative to fold the main gown along at least two transverse fold lines. Toward this end, preferred embodiments of the transverse folding section comprise first and second folding nips located opposite respective first and second downslope conveyors. First and second reciprocative elements are provided to operatively engage the garment along a respective transverse fold line and move it into an associated folding nip.

In some exemplary embodiments, the infeed section delivers the garment to the sleeve-tucking section in a manner that forms an initial transverse fold in the garment. For example, the platen surface of the infeed section may be reciprocatively movable to and from a location adjacent a nip defined at an entrance of the sleeve-tucking section.

The sleeve-tucking section may be constructed including a first dead plate of a width approximately equal to the garment. A first conveyor is spaced slightly above and opposing the first dead plate to move the garment therealong. Similarly, the longitudinal folding section may include a second dead plate of a width less than the garment. A second conveyor is spaced slightly above and opposing the second dead plate to also move the garment.

In such embodiments, the sleeve-tucking section may be constructed having first and second movable sleeve tuckers located below opposite lateral sides of the first dead plate. The longitudinal folding section may include first and second fixed folder plates located below the second dead plate.

Still further objects of the invention are achieved by an apparatus for folding a garment. The apparatus comprises an infeed section having a horizontal platen surface reciprocatively movable between a recess position and a garment delivery position.

A longitudinal folding section is further provided, including a lesser width dead plate having a width less than the garment. A conveyor opposes the lesser width dead plate to move the garment therealong. The longitudinal folding section further includes first and second folder plates located below the lesser width dead plate.

The apparatus includes a transverse folding section having first and second folding nips located opposite respective first and second downslope conveyors. In addition, first and second reciprocative elements operatively engage the garment along a transverse fold line and move it into a respective folding nip. A support element is provided at an output of the transverse folding section to which the garment is delivered.

In some exemplary embodiments, the apparatus may include a sleeve-tucking section operatively preceding the longitudinal folding section. The sleeve-tucking section functions to fold sleeves of the garment behind a back portion thereof.

Preferably, the sleeve-tucking section includes a greater width dead plate of a width approximately equal to the garment. A further conveyor is provided in such embodiments to oppose the greater width dead plate to move the garment therealong. The sleeve-tucking section preferably comprises first and second movable sleeve tuckers located below opposite lateral sides of the greater width dead plate. The infeed section may be configured in such embodiments to deliver the garment to the sleeve-tucking section in a manner that forms a transverse fold in the garment.

Additional objects of the invention are achieved by a method of folding a surgical gown having a main gown to which respective left and right sleeves are attached. One step of the method involves folding left and right flaps of the main gown at least partially back upon themselves to expose an interior surface of the main gown. Another step of the method involves folding the sleeves behind a back portion of the main gown.

The main gown is further folded back along first and second longitudinal fold lines extending substantially parallel to respective lateral sides thereof. After folding along the first and second longitudinal fold lines, the main gown is folded back along at least one transverse fold line extending substantially transverse to the lateral sides of the main gown to define left and right hand pockets. Finally, the main gown is folded along a third longitudinal fold line to form a folded surgical gown such that the hand pockets are located on opposite sides thereof.

According to presently preferred methodology, the main gown is folded back along first and second transverse fold lines after being folded along the first and second longitudinal fold lines. Preferably, the main gown is further folded back along an initial transverse fold line before being folded along the first and second longitudinal fold lines. For example, the main gown may be folded along the initial and first and second transverse fold lines into a length of less than approximately one-fourth the original longitudinal length.

As an additional method step, the sleeves may be folded behind the back portion of the main gown before the main gown is folded along the initial transverse fold line. In this regard, the sleeves may be folded behind the back portion of the main gown at an acute angle from a transverse dimension of the main gown. For example, the sleeves may each be folded in at the lateral sides of the main gown to completely cross one another behind the back portion of the main gown. Alternatively, the sleeves may each be folded in at the lateral sides of the main gown and out at an intermediate location thereof back toward the lateral sides.

Other objects of the invention are achieved by a method of folding a long-sleeved garment having a back portion and an opposed front portion defining left and right flaps. One step of the method involves folding the flaps at least partially back upon themselves to expose an interior surface of the garment. As an additional step, the sleeves are folded behind the back portion at an acute angle to a transverse dimension thereof.

As a further step, a selected length of the garment is folded back along an initial transverse fold. The garment is also back folded along first and second longitudinal fold lines extending substantially parallel to respective lateral sides thereof. In addition, the garment is folded back along two subsequent transverse fold lines extending substantially transverse to the lateral sides such that the garment has a longitudinal length of less than approximately one-fourth an original longitudinal length thereof.

According to presently preferred methodology, the garment is further folded along a central longitudinal fold line to form a folded garment wherein left and right hand pockets are located on opposite sides thereof. Donning of the garment is thus facilitated by a wearer without touching an outer surface of the garment.

Other objects, features and aspects of the present invention are provided by various combinations and subcombinations of the disclosed elements, as well as methods of utilizing same, which are discussed in greater detail below.

BRIEF DESCRIPTION OF THE DRAWINGS

A full and enabling disclosure of the present invention, including the best mode thereof, to one skilled in the art, is set forth more particularly in the remainder of the specification, including reference to the accompanying drawings, in which.

Figure 1:
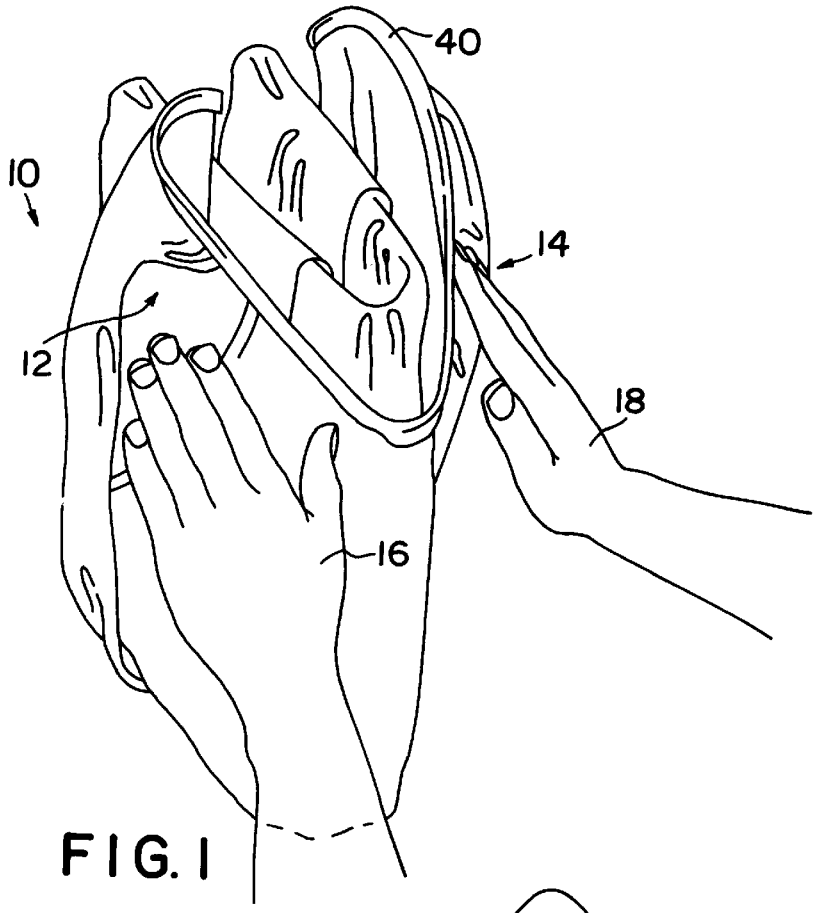
FIG. 1 is a perspective view of a surgical gown folded according to the present invention showing insertion of a wearer's hands into respective hand pockets thereof.

Repeat use of reference characters in the present specification and drawings is intended to represent same or analogous features or elements of the invention.

DETAILED DESCRIPTION OF PREFERRED EMBODIMENTS

It is to be understood by one of skill in the art that the present discussion is a description of exemplary embodiments only, and is not intended as limiting the broader aspects of the present invention, which broader aspects are embodied in the exemplary constructions.

Referring to FIG. 1, a surgical gown 10 is shown in an improved folded arrangement produced according to the present invention. Like prior art "book-folds," exterior surfaces of the gown are contained largely within the folded garment. Left and right hand pockets 12 and 14 are also provided on opposite sides of the folded garment for receipt of respective hands 16 and 18 of the wearer.

Figure 2:
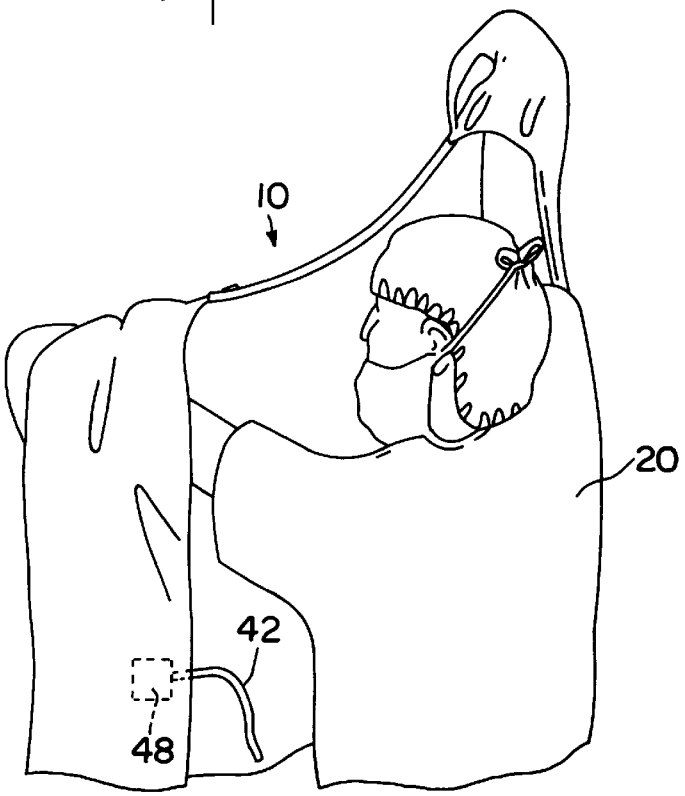
FIG. 2 illustrates aseptic donning of the surgical gown of FIG. 1 by a wearer.

As with prior art book-folds, the illustrated arrangement allows aseptic donning of gown 10 by a medical professional. First, the wearer's hands 16 and 18 are inserted into respective hand pockets 12 and 14. Next, as shown in FIG. 2, wearer 20 lifts gown 10 with arms separated, causing gown 10 to unfold. Gown 10 then falls into place about the shoulders of wearer 20. Significantly, wearer 20 thus dons gown 10 without touching the gown's exterior surface.

Figure 3A:
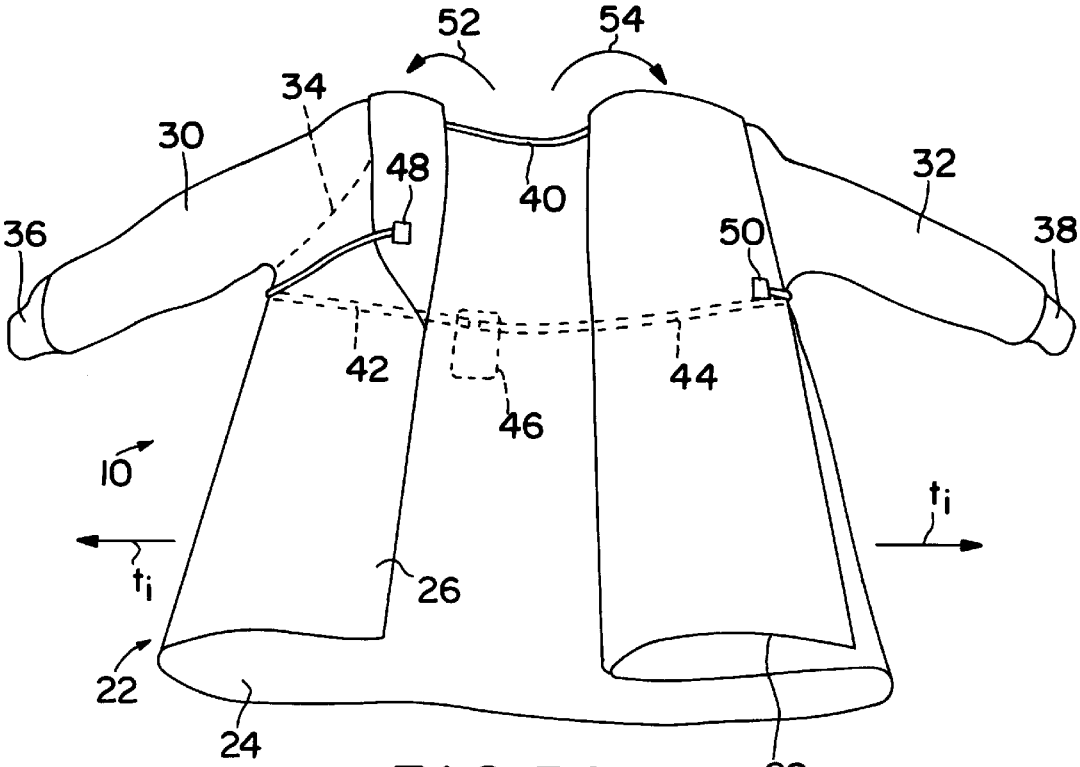
FIGS. 3A through 3H illustrate folding of a surgical gown according to the present invention to achieve an improved folded arrangement.

Referring now to FIG. 3A, gown 10 is shown lying substantially flat. Gown 10 includes a main gown 22 constructed in this case as a unitary sheet having a back portion 24 and an opposed front portion comprising left and right flaps 26 and 28. It will be appreciated that the terms "front portion" and "back portion" are merely a matter of convention adopted for purposes of explanation. Typically, the "back portion" will cover the wearer's chest, whereas the "front portion" will be behind the wearer.

Gown 10 further includes a pair of sleeves 30 and 32 attached to main gown 22 by appropriate means, such as stitching 34. In this case, sleeves 30 and 32 are equipped with respective cuffs 36 and 38 at the distal ends thereof. Preferably, cuffs 36 and 38 may be made from knitted fabric, whereas the remainder of gown 10 will be nonwoven. The nonwoven material chosen for this purpose is preferably of a type which is breathable from the inside, while being reasonably impervious to fluid penetration from the outside.

A reinforced collar 40, also preferably nonwoven, may be stitched or otherwise suitably attached along the upper portion of main gown 22. In addition, gown 10 will often be equipped with a pair of straps 42 and 44 initially extending behind back portion 24 as shown, where they are retained by a retaining tag 46. Straps 42 and 46 will often be attached to the insides of flaps 26 and 28 by respective tape pieces 48 and 50. Other suitable means may also be utilized, however, for attaching straps 42 and 44.

When gown 10 is donned, another medical professional (other than the wearer) will typically pull retaining tag 46, freeing the respective straps 42 and 44. Straps 42 and 44 can then be brought around the wearer's back and tied off to prevent inadvertent doffing of the gown.

A preferred manner in which gown 10 may be folded is illustrated in FIGS. 3A through 3H. Referring particularly to FIG. 3A, flaps 26 and 28 are first folded at least partially back upon themselves, as indicated at 52 and 54, to expose the interior surface of gown 10.

Figure 3B:
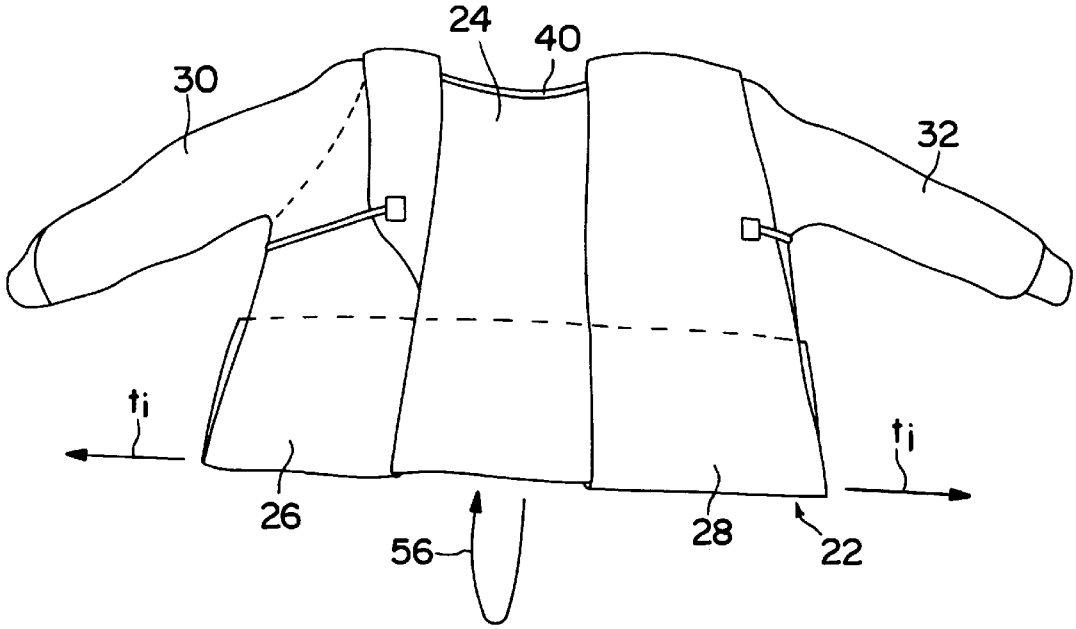

In this case, main gown 22 is folded back along an initial transverse fold line $t_i$, as indicated in FIG. 3B at 56. Preferably, the longitudinal length of the section folded behind back portion 24 in this manner will be between one-fourth and one-half the overall longitudinal length of main gown 22. For example, the section so folded may extend almost back to collar 40.

Figure 3C:
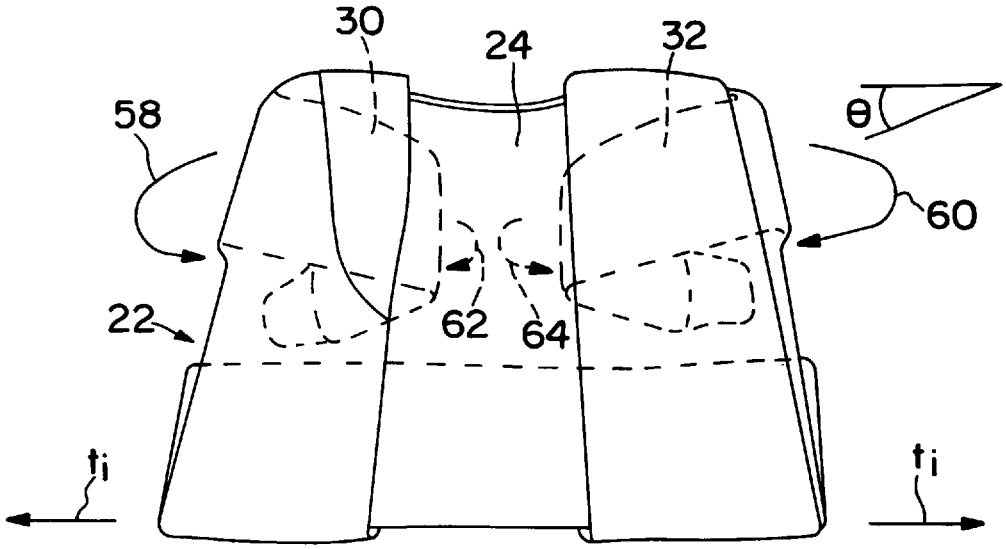
Figure 3D:
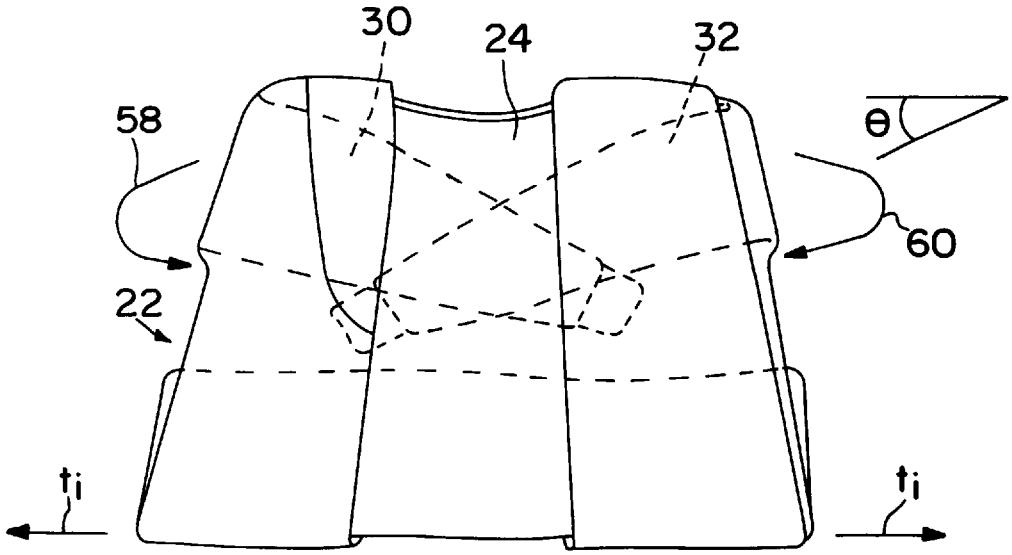

Referring now to FIGS. 3C and 3D, sleeves 30 and 32 are folded behind back portion 24 at an acute angle $\Theta$ from the transverse dimension of main gown 24. In FIG. 3C, sleeves 30 and 32 are folded inward at a location adjacent the lateral sides of main gown 22 as indicated at 58 and 60, and outward at an intermediate location as indicated at 62 and 64. As shown in FIG. 3D, sleeves 30 and 32 may alternatively be folded only inward to cross one another. Sleeve folding may occur either before or after the initial transverse fold shown in FIG. 3B, depending on the exigencies of a particular application.

Figure 3E:
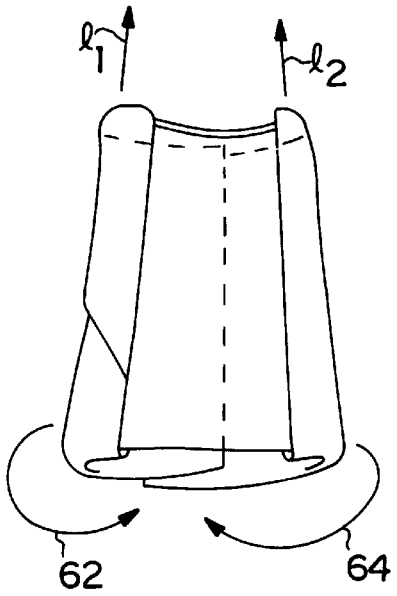
Figure 3F:
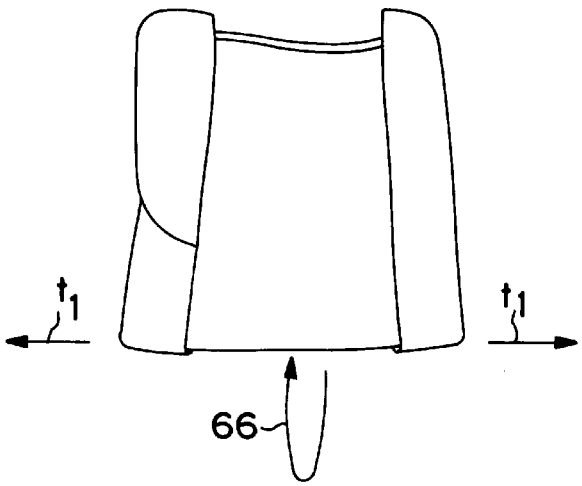
Figure 3G:
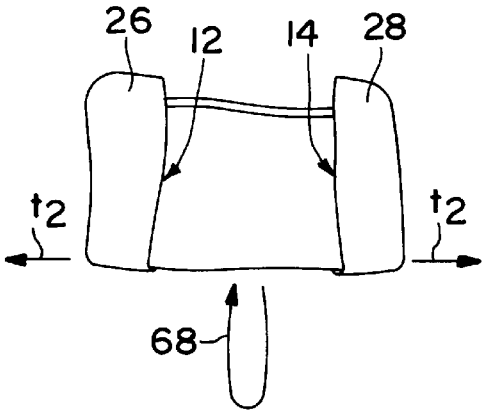

As shown in FIG. 3E, main gown 22 is then back folded as indicated at 62 and 64 along a pair of longitudinal fold lines $l_1$ and $l_2$. Next, as indicated at 66 in FIG. 3F, a selected length of main gown 22 is back folded along a transverse fold line $t_1$. Another selected length of main gown 22 is then folded along an additional transverse fold line $t_2$, as shown at 68 of FIG. 3G.

Preferably, the length of main gown folded at both $t_1$ and $t_2$ will be approximately one-third the remaining longitudinal length of main gown 22 after the fold at $t_i$ has been effected. The resulting folded garment will thus have a longitudinal length less than approximately one-fourth the original length of main gown 22. The transverse width of the folded garment at this stage will be defined by the width remaining after the folds along $l_1$ and $l_2$.

Figure 3H:
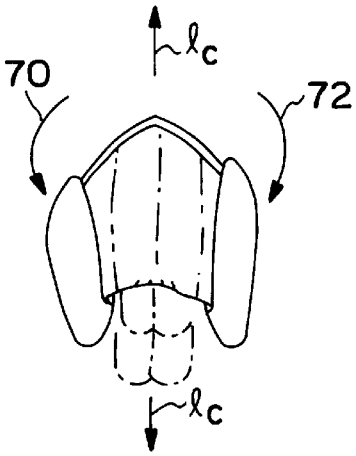

Apparent at this stage in the folded garment are hand pockets 12 and 14, which are formed under flaps 26 and 28. As shown in FIG. 3H, the final "book-fold" arrangement is produced by a single fold along a central longitudinal fold line $l_c$. In other words, further folding as indicated at 70 and 72 will place hand pockets 12 and 14 on opposite sides of the garment, as desired.

Figure 4:
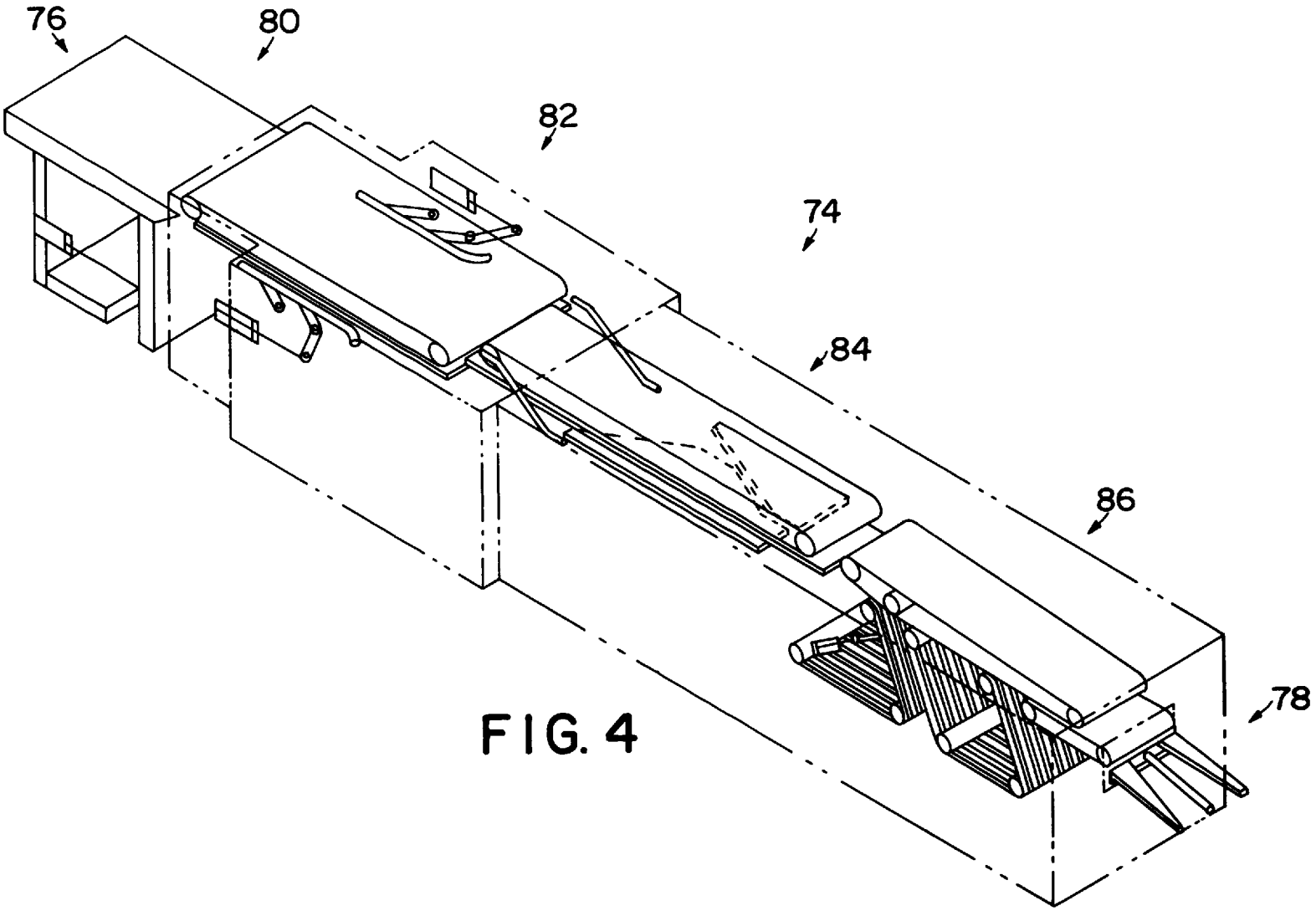
FIG. 4 is a perspective view of an apparatus constructed in accordance with the present invention for producing a folded garment.

In contrast to the prior art, the folding sequence shown in FIGS. 3A through 3H is particularly amenable to automated processing. In this regard, FIG. 4 illustrates a preferred embodiment of an apparatus 74 for producing such a folded garment. As can be seen, apparatus 74 includes a number of functional sections arranged in series from an input end 76 to an output end 78. These functional sections include an infeed section 80, a sleeve-tucking section 82, a longitudinal folding section 84 and a transverse folding section 86.

Figure 5:
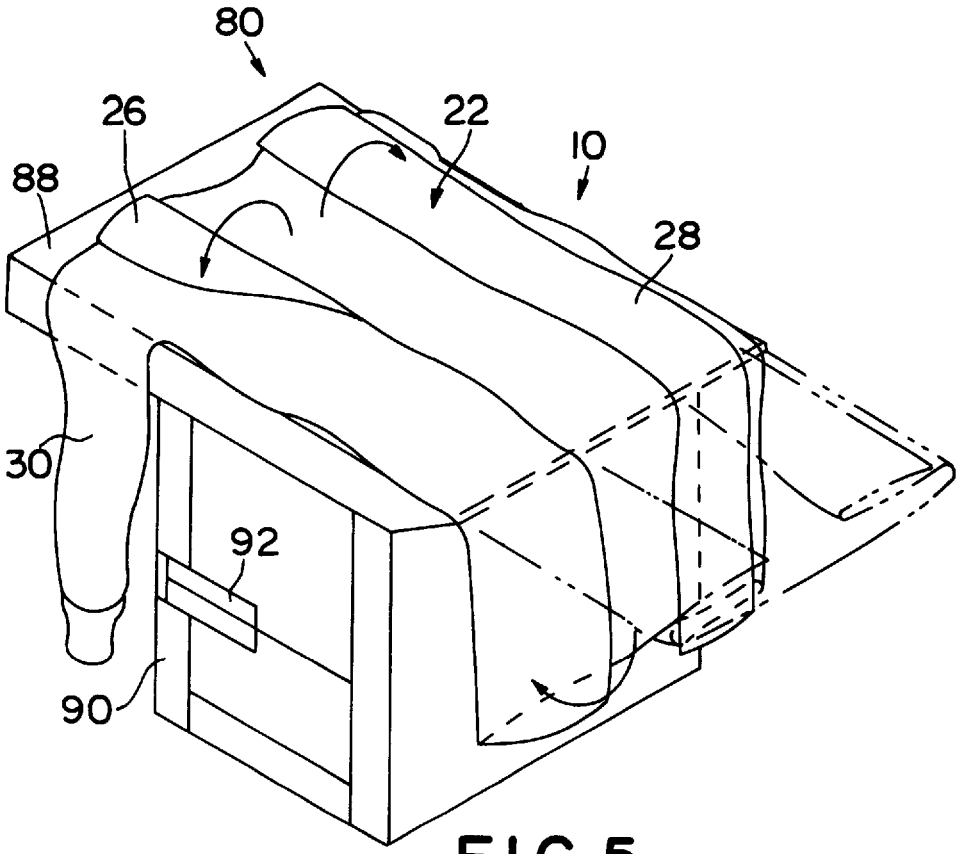
FIG. 5 is a perspective view of an infeed section of the apparatus of FIG. 4.

Turning now to FIG. 5, infeed section 80 is shown in greater detail. Infeed section 80 includes a platen surface 88 onto which gown 10 is placed at the beginning of the folding sequence. Surface 88 is preferably sized so that sleeves 30 and 32, as well as a selected length of main gown 22, may hang vertically as shown. When gown 10 is placed on surface 88 in this manner, the operator will preferably prefold flaps 26 and 28 back upon themselves in the manner shown in FIG. 3A.

Figure 6:
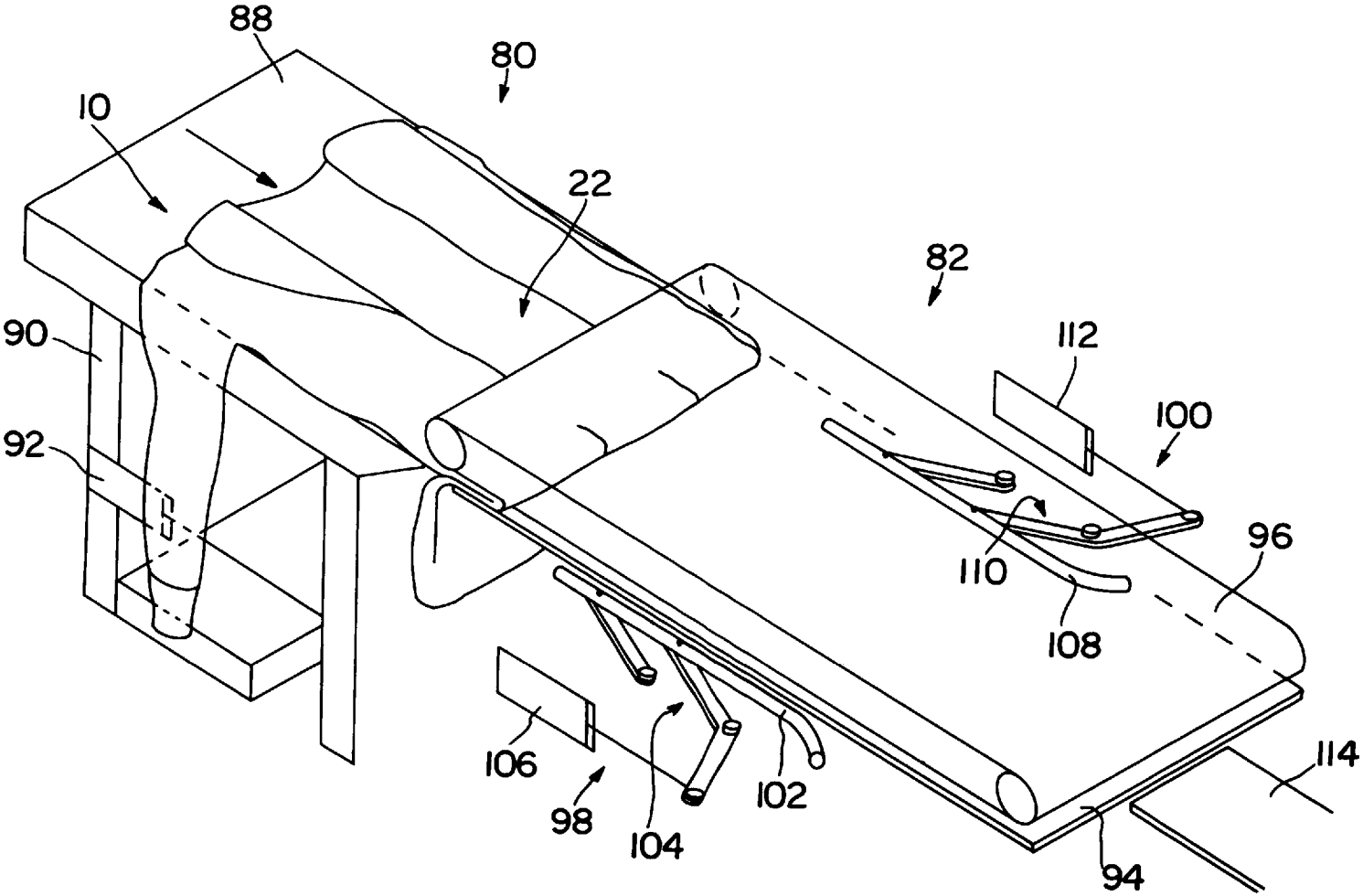
FIG. 6 is a perspective view illustrating the operative relationship between the infeed section and a sleeve-tucking section of the apparatus of FIG. 4.

Referring now also to FIG. 6, platen surface 88 is reciprocatively movable against a fixed frame 90. For example, one or more fluid cylinders, such as cylinder 92, may be provided for reciprocatively moving platen surface 88 to and from a location adjacent an intake of sleeve-tucking section 82. Toward this end, platen surface 88 may include rollers or the like which roll upon an underlying track defined in fixed frame 90. Any appropriate means may be provided to permit selective activation of the fluid cylinders by the operator. For example, presently preferred embodiments utilize an electric eye arrangement whereby the operator's hand is waved to activate the fluid cylinders.

As can be seen, sleeve-tucking section 82 includes a dead plate 94 having a width approximately the same as main gown 22. An endless conveyor 96 is positioned overlying and slightly spaced from dead plate 94 to engage and move gown 10 therealong. When gown 10 is delivered to sleeve-tucking section by the reciprocative movement of platen surface 88, the initial transverse fold (as shown in FIG. 3B) is automatically produced by the nip between dead plate 94 and conveyor 96.

Figure 7A:
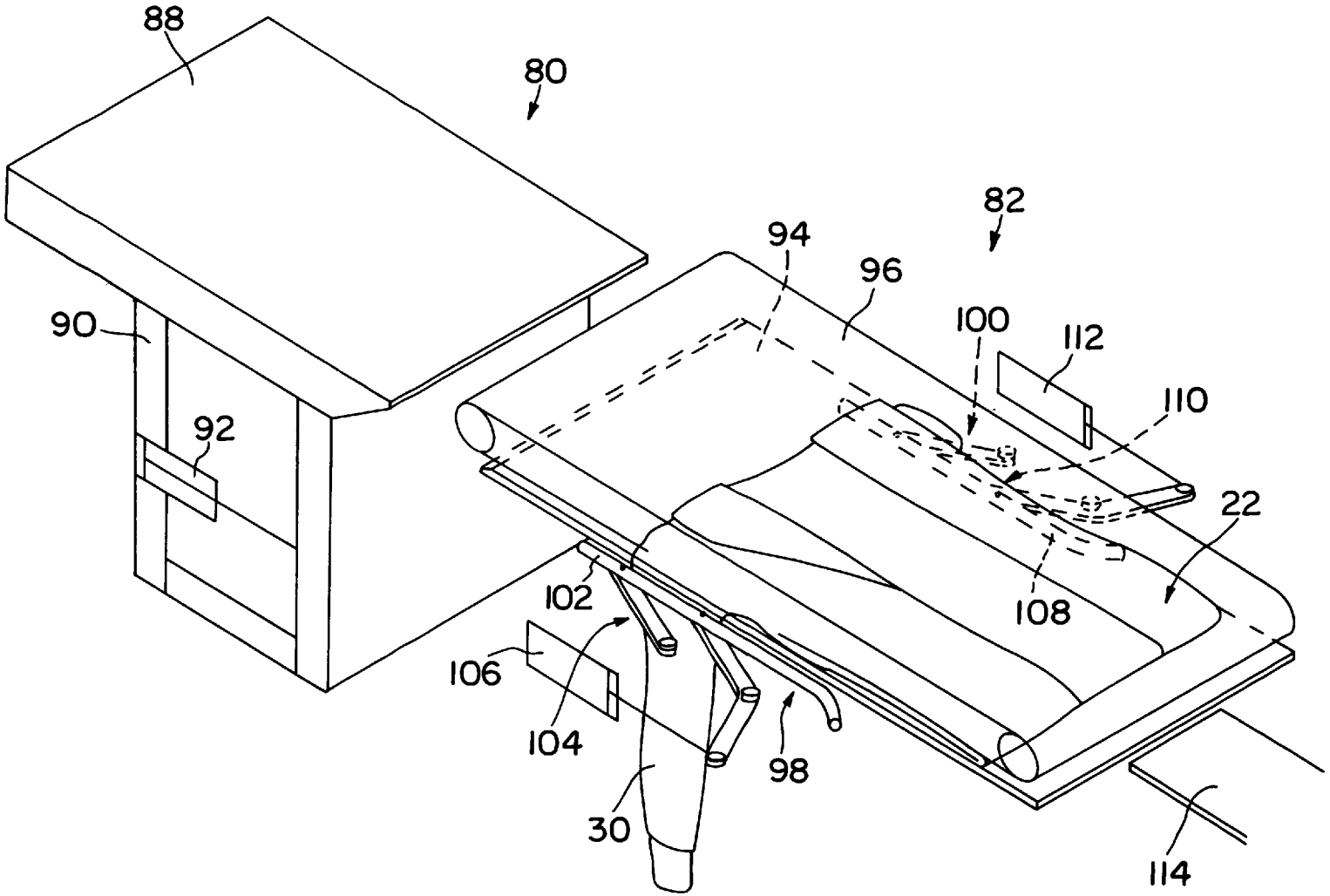
FIGS. 7A and 7B are perspective views illustrating operation of the sleeve-tucking section of the apparatus of FIG. 4.
Figure 7B:
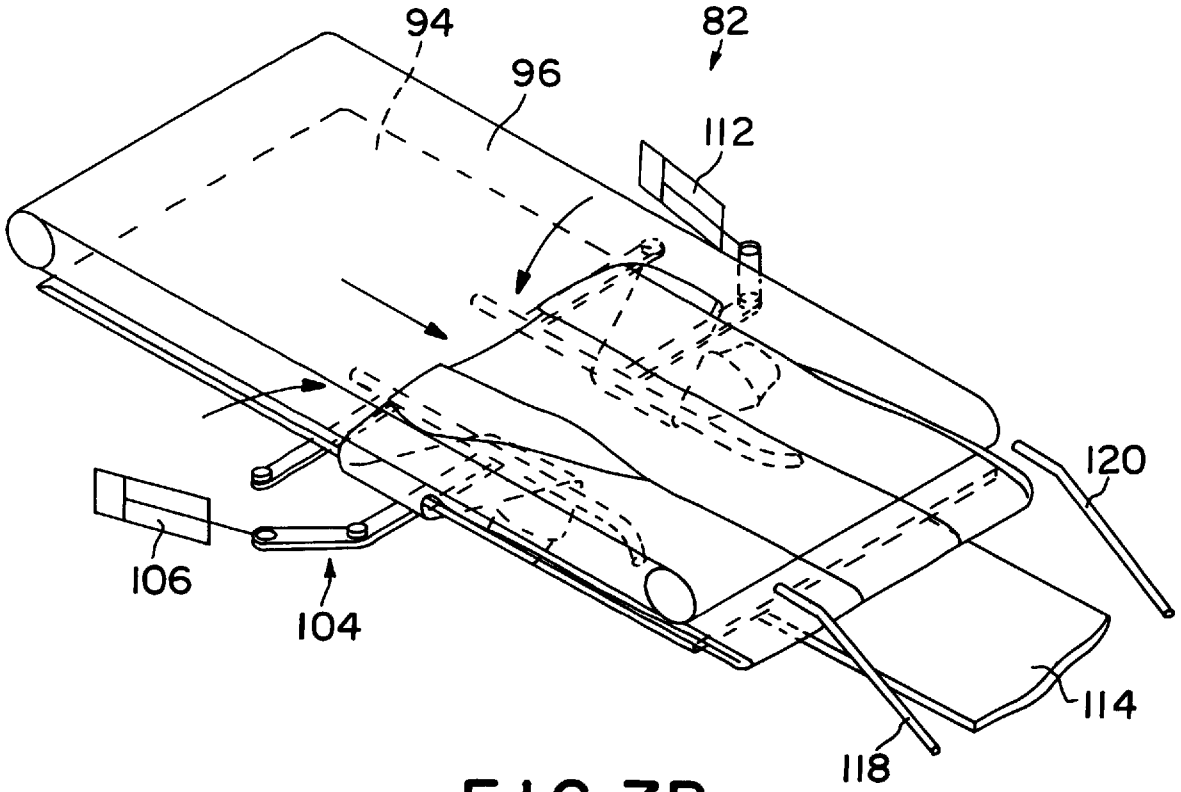

The operation of sleeve-tucking section 82 is shown in FIGS. 7A and 7B. A pair of sleeve-tuckers 98 and 100 are located beside the opposite lateral sides of dead plate 94. As shown particularly in FIG. 7B, sleeve-tuckers 98 and 100 movably engage respective sleeves 30 and 32. As a result, sleeves 30 and 32 are folded behind dead plate 94 in the manner illustrated in FIG. 3C.

Sleeve tuckers 98 and 100 comprise respective longitudinal elements situated in parallel to dead plate 94 and movable in a direction transverse thereto. For example, sleeve tucker 98 includes a longitudinal rod 102 pivotally connected to a four-bar linkage 104, which is itself pivotally connected to the fixed frame. A fluid cylinder 106 is also pivotally connected to four-bar linkage 104 to cause the transverse movement of rod 102 at the desired time. An electric eye or other suitable activation means may be employed to detect the position of gown 10 and initiate activation of fluid cylinder 106. It can be seen that sleeve-tucker 100 is similarly constructed, comprising longitudinal rod 108, four-bar linkage 110 and fluid cylinder 112.

Figure 8C:
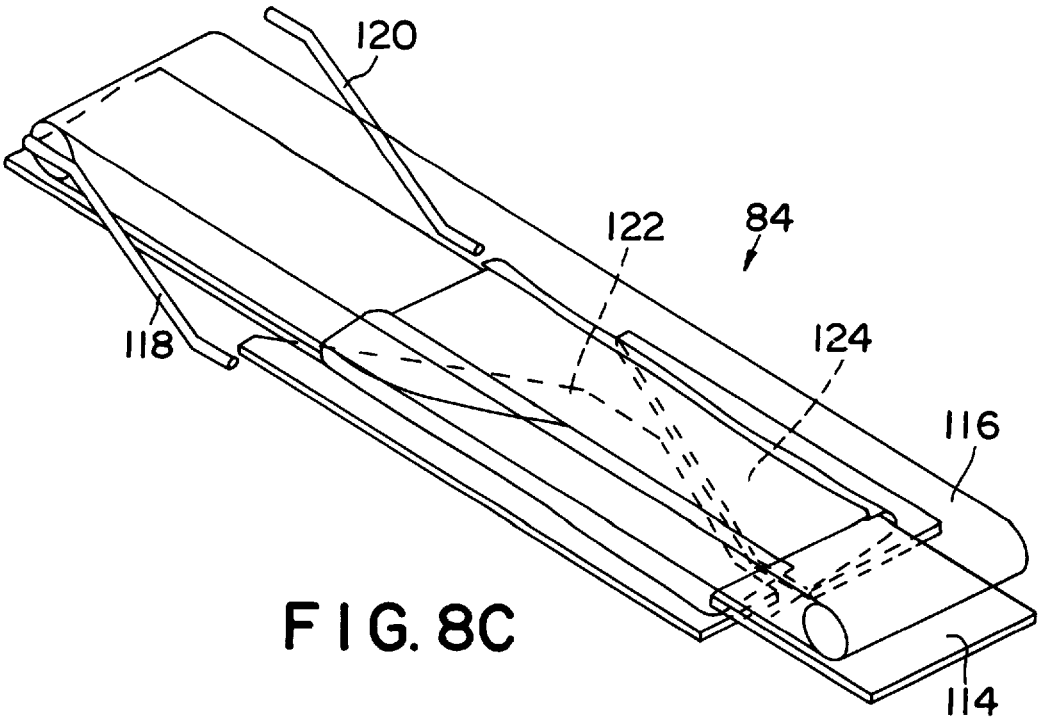
FIGS. 8A through 8C are perspective views illustrating operation of a longitudinal folding section of the apparatus of FIG. 4.

As will now be described with reference to FIGS. 8A through 8C, longitudinal folding section 84 functions to fold gown 10 along longitudinal fold lines as illustrated in FIG. 3E. Toward this end, longitudinal folding section 84 includes a dead plate 114 underlying an endless conveyor 116. It will be noted that the width of dead plate 114 is considerably less than dead plate 94 to allow the longitudinal folds produced in this section.

A pair of fixed guide rods 118 and 120 are located adjacent lateral sides of dead plate 114 near the output of sleeve-tucking section 82. In addition, longitudinal folding section 84 further includes a pair of fixed folding plates 122 and 124 located below dead plate 114. As shown, right folding plate 122 is situated slightly ahead of left folding plate 124 in the product stream. As the leading plate, right folding plate 122 will preferably be located slightly above left folding plate 124.

Figure 8A:
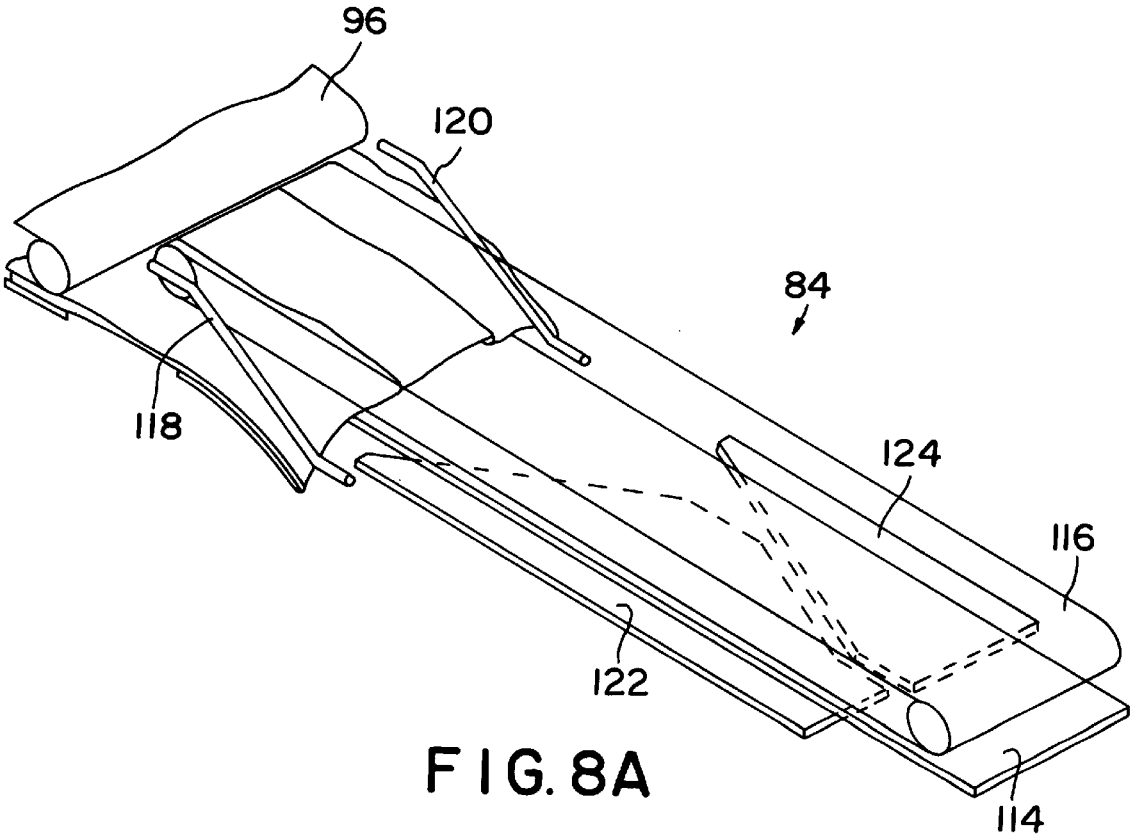
Figure 8B:
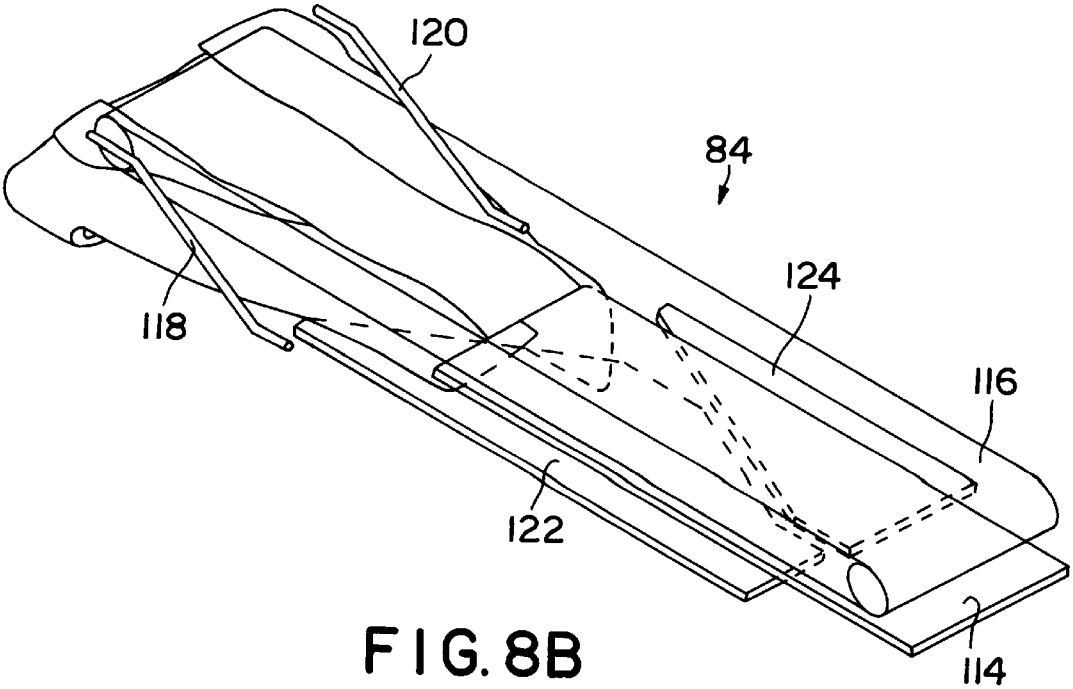

As can be seen in FIG. 8A, gown 10 first engages guide rods 118 and 120 as it is received on dead plate 114 from the output of sleeve-tucking section 82. The slope of guide rods 118 and 120 thus begins the desired longitudinal folds about dead plate 114. Next, as shown in FIG. 8B, the depending flaps formed in this manner engage the angled leading faces of folding plates 122 and 124. As a result, the flaps are folded behind dead plate 114 in the desired manner, as illustrated in FIG. 8C.

Figure 9:
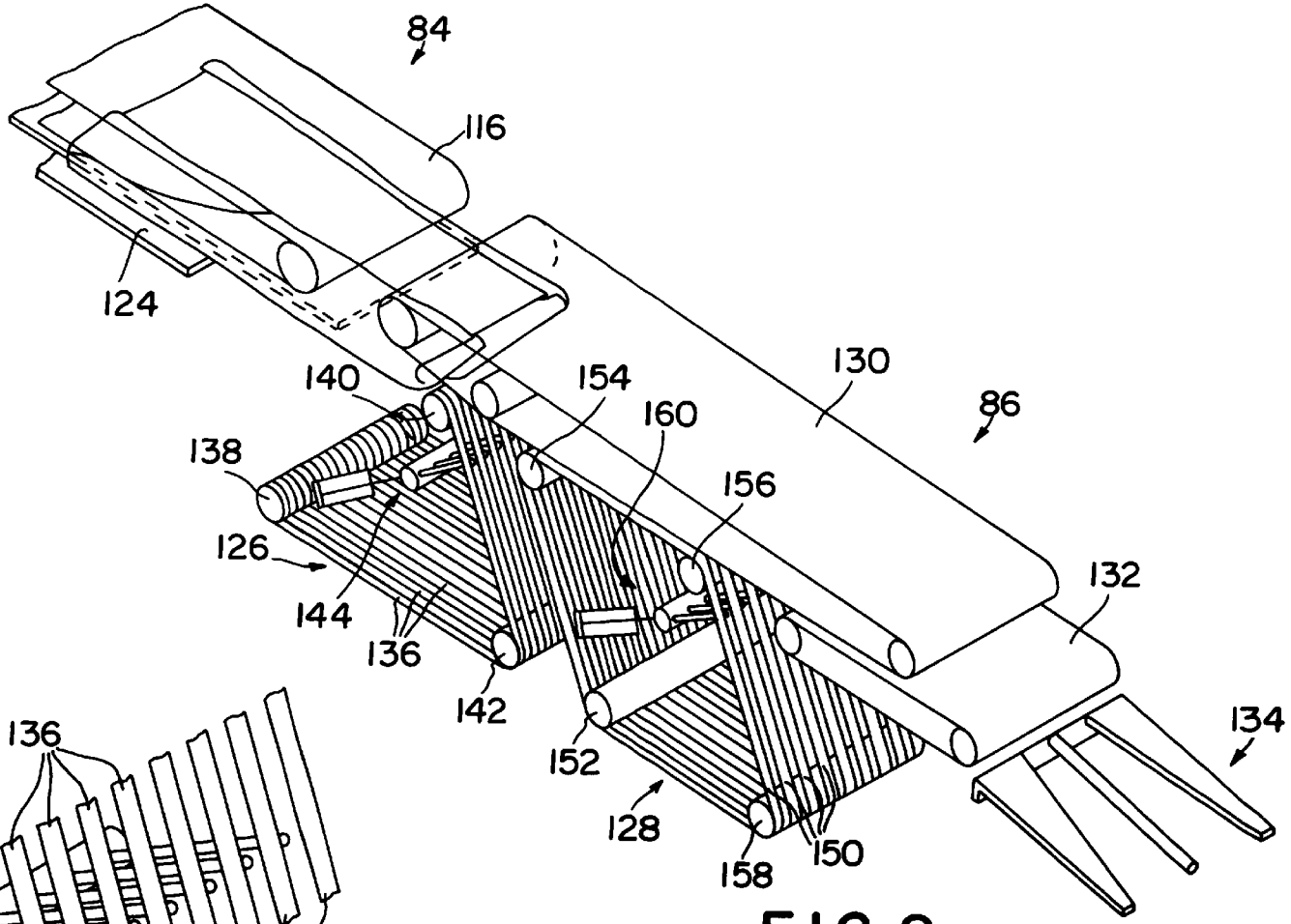
FIG. 9 is a perspective view illustrating the operative relationship between the longitudinal folding section and a transverse folding section of the apparatus of FIG. 4.

Referring now to FIG. 9, the garment then proceeds to transverse folding section 86. In this case, transverse folding section 86 includes respective folding mechanisms 126 and 128 for sequentially producing a pair of transverse folds. As shown, folding mechanisms 126 and 128 are opposed by a relatively lengthy overhead conveyor 130. A delivery conveyor 132 is also provided to move the garment to a support element 134 at the output end of the overall apparatus.

Figure 9A:
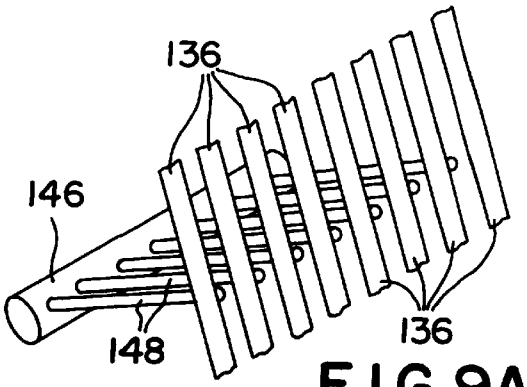
FIG. 9A is an enlarged perspective view of a preferred reciprocative mechanism utilized in the transverse folding section of FIG. 9.

As can be seen, folding mechanism 126 includes a plurality of endless belts 136 extending about three rollers 138, 140 and 142 in a triangular arrangement. A fluid-actuated engaging mechanism 144 is located inside of the triangular structure to engage the garment along a first transverse fold line as will be explained below. Referring now also to FIG. 9A, engaging mechanism 144 comprises a base bar 146 having a plurality of finger members 148 attached thereto. Finger members 148 are located to extend between adjacent belts 136 when engaging mechanism 144 is activated.

Folding mechanism 128 similarly includes a plurality of endless belts 150. In this case, however, belts 150 extend about four rollers 152, 154 156 and 158 in a parallelogram arrangement. A fluid-actuated engaging mechanism 160, similar in its construction to engaging mechanism 144, is located inside of the parallelogram structure to engage the garment along a second transverse fold line.

As can be clearly seen in FIGS. 10A through 10E, the triangular structure of folding mechanism 126 provides a downslope 162 in the garment travel path. A nip 164, formed between overhead conveyor 130 and folding mechanism 128, is located opposite downslope 162 in alignment with engaging mechanism 144. Similarly, folding mechanism 128 provides a downslope 166 and an opposing nip 168. Nip 168 is formed between overhead conveyor 130 and delivery conveyor 132.

Figure 10A:
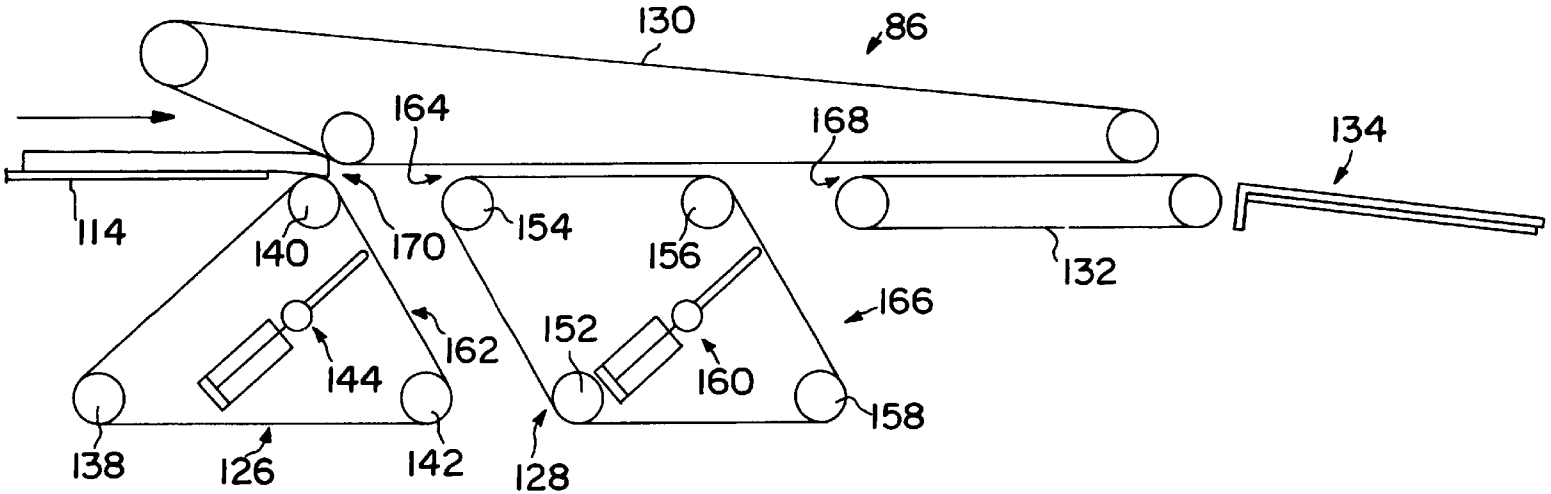
FIGS. 10A through 10E are elevational views illustrating operation of the transverse folding section of the apparatus of FIG. 4.
Figure 10B:
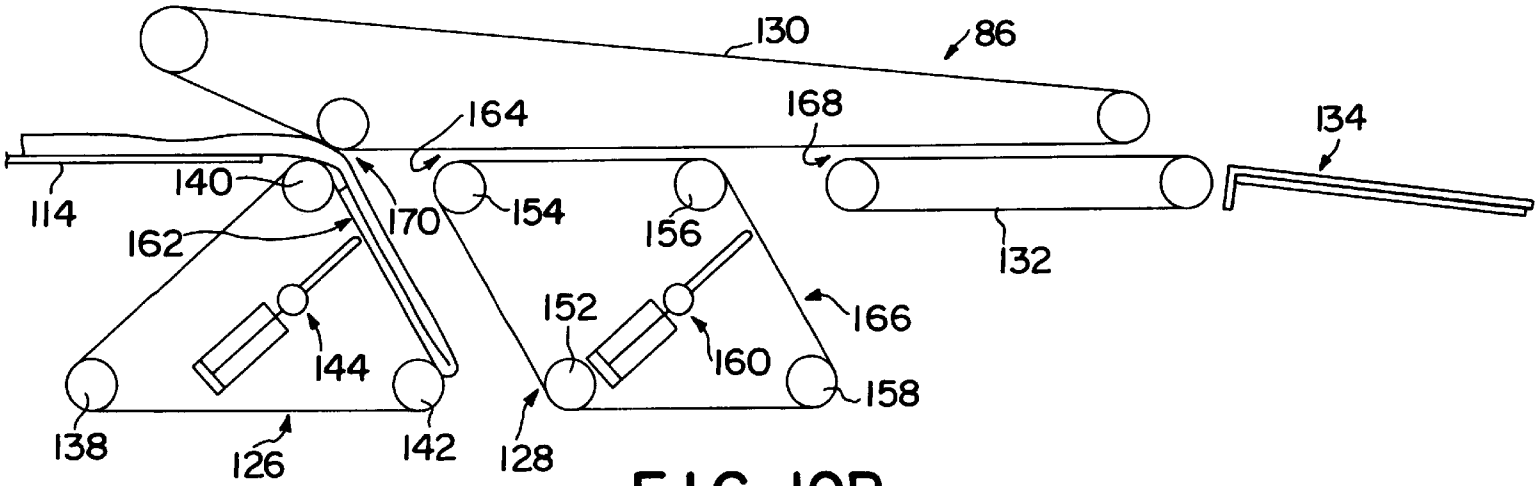
Figure 10C:
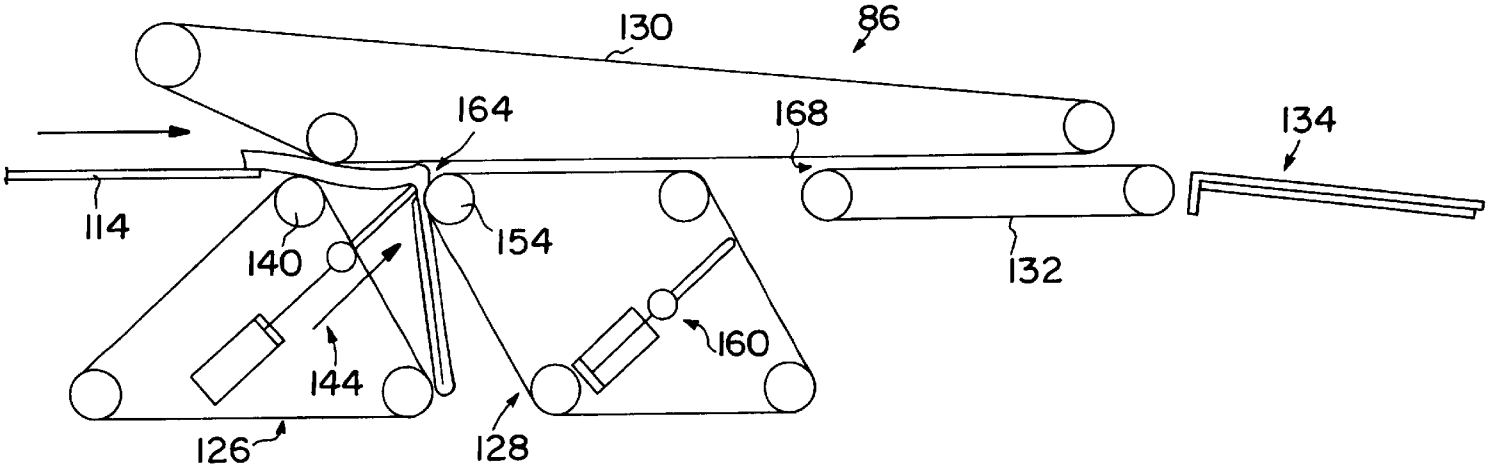

As shown in FIGS. 10A and 10B, the garment is carried from dead plate 114 into a nip 170 defined between roller 140 and an opposed roller 172 about which overhead conveyor 130 extends. The garment then proceeds along downslope 162, until engaging mechanism 144 is activated as shown in FIG. 10C. As a result, the garment will be inserted into nip 164 along the first transverse fold line.

In presently preferred embodiments, activation of engaging mechanism 144 may be effected utilizing a suitable electric eye arrangement. For example, an electric eye may be located adjacent nip 170 to detect when a leading edge of the garment has passed. Suitable delay circuitry can then activate engaging mechanism at the appropriate time.

Figure 10D:
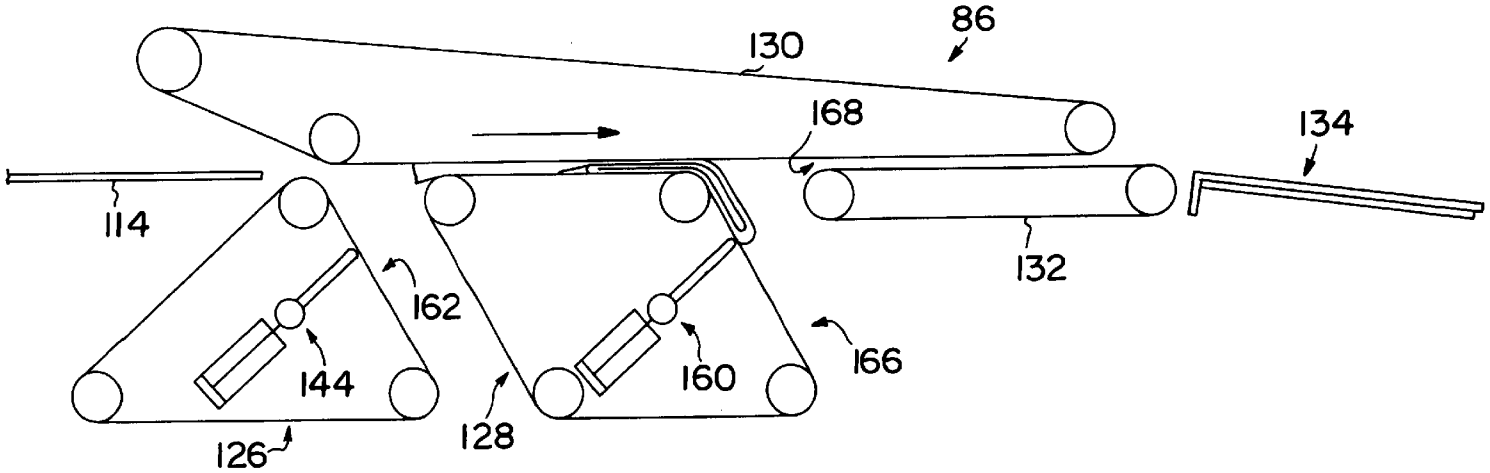
Figure 10E:
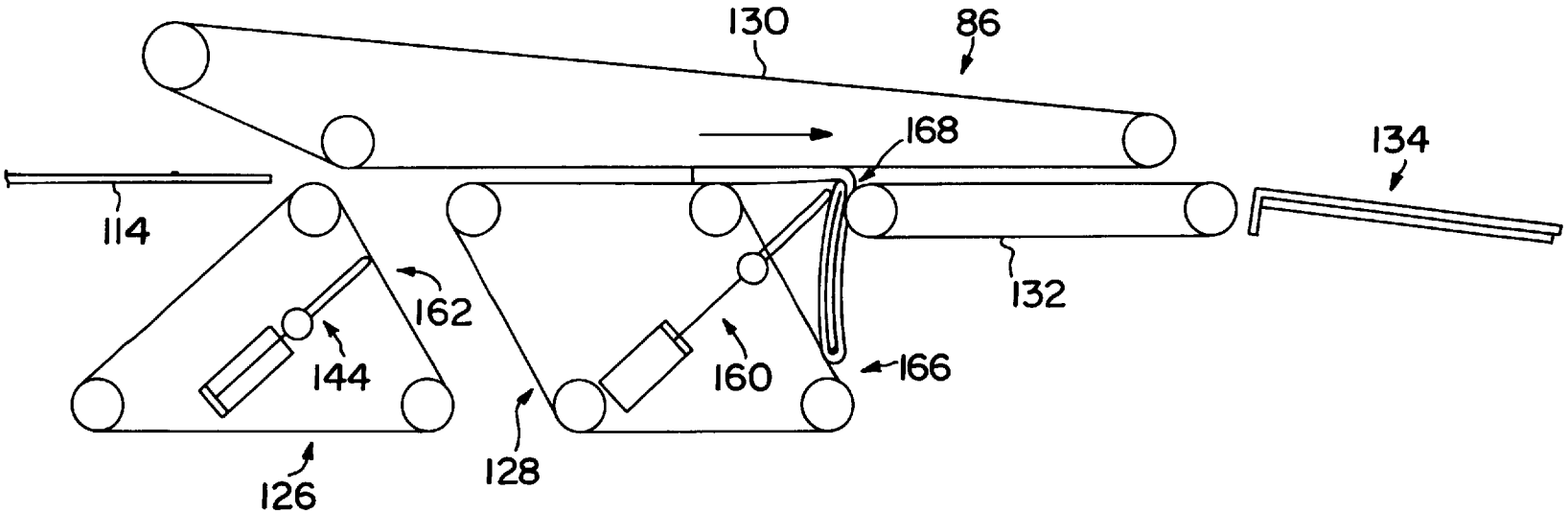

As illustrated in FIG. 10D, the garment next proceeds along the top of folding mechanism 128 and subsequently along downslope 166. At a predetermined time, engaging mechanism 160 will be activated as shown in FIG. 10E. As a result, the garment will be forced into nip 168 along the second longitudinal fold line. Like engaging mechanism 144, engaging mechanism 160 can be activated in this manner utilizing an electric eye and appropriate time delay circuitry. This electric eye can be located, for example, along the top of folding mechanism 128.

Figure 11:
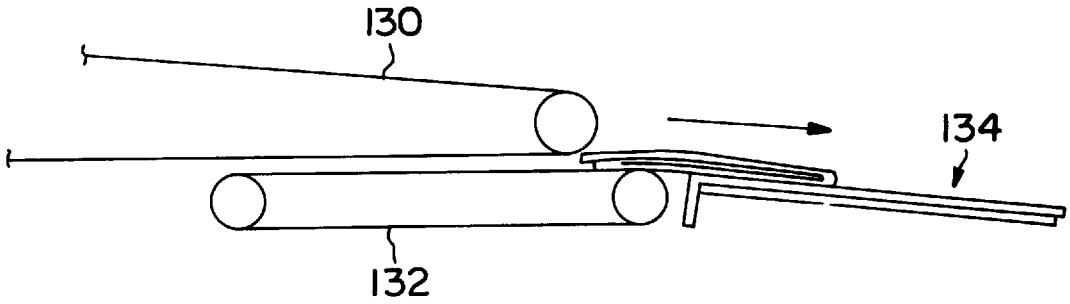
FIG. 11 is an elevational view showing delivery of a garment from a output of the transverse folding section to a support element of the apparatus of FIG. 4.
Figure 12:
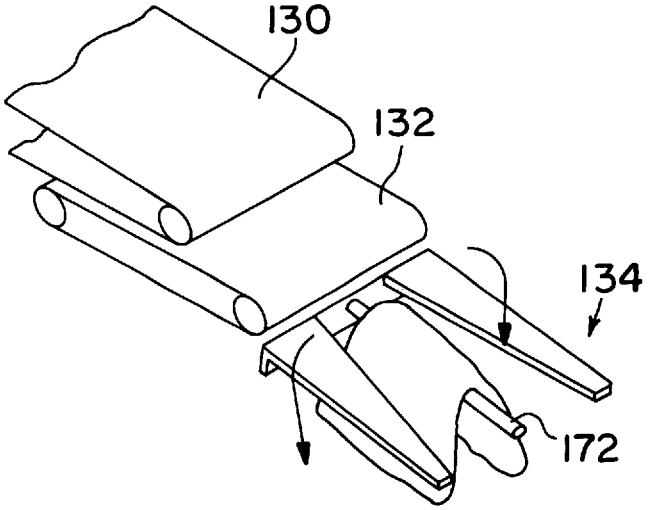
FIG. 12 is a perspective view illustrating use of the support element to manually form a final fold in the garment.

As shown in FIG. 11, the garment is then passed to support element 134 by delivery conveyor 132. At this stage, the garment will be fully folded except for the central longitudinal fold illustrated in FIG. 3H. As shown in FIG. 12, support element 134 may include a longitudinal rod 172 about which this final fold can be easily made by the machine operator.

It can be seen that the present invention provides a surgical gown in an improved folded arrangement, as well as methods and apparatus for producing same. While preferred embodiments and preferred methodology have been shown and described, modifications and variations may be made thereto. For example, the sleeves may be tucked manually at the input of a garment folding apparatus, thus eliminating the need to provide an automated sleeve-tucking section.

One of skill in the art will appreciate that these and other modifications and variations are included within the spirit and scope of the present invention, which is more particularly set forth in the appended claims. In addition, it should be understood that aspects of the invention may be interchanged both in whole or in part. Furthermore, those of ordinary skill in the art will appreciate that the foregoing description is by way of example only, and is not intended to be limitative of the invention so further described in such appended claims.

What is claimed is:

1. A surgical gown comprising:

a main gown configured to cover a predetermined area of a wearer's body, said main gown having a back portion and an opposed front portion, said front portion having respective left and right flaps;

left and right sleeves attached to said main gown to extend from respective lateral sides thereof;

said surgical gown being folded in a manner including:

(a) each of said left and right flaps being turned at least partially back upon itself to expose an interior surface of said main gown;

(b) said left and right sleeves each being folded behind said back portion of said main gown;

(c) said main gown being back folded along first and second longitudinal fold lines extending substantially parallel to said lateral sides thereof;

(d) said main gown being further back folded after folding along said longitudinal fold lines along at least one transverse fold line substantially transverse to said lateral sides of said main gown to define left and right hand pockets; and (d) said main gown being folded along a third longitudinal fold line to form a folded surgical gown such that said left and right hand pockets are located on opposite sides thereof.

2. A surgical gown as set forth in claim 1, wherein said main gown is back folded along first and second transverse fold lines after being back folded along said first and second longitudinal fold lines.

3. A surgical gown as set forth in claim 2, wherein said main gown is further back folded along an initial transverse fold line before being back folded along said first and second longitudinal fold lines.

4. A surgical gown as set forth in claim 3, wherein said main gown is folded along said initial transverse fold line and first and second transverse fold lines to have a final longitudinal length less than approximately one-fourth an initial longitudinal length of said main gown.

5. A surgical gown as set forth in claim 3, wherein said sleeves are folded behind said back portion of said main gown before said main gown is folded along said initial transverse fold line.

6. A surgical gown as set forth in claim 5, wherein said sleeves are folded behind said back portion of said main gown at an acute angle from a transverse dimension of said main gown.

7. A surgical gown as set forth in claim 6, wherein said sleeves are each folded in at said lateral sides of said main gown to completely cross one another behind said back portion of said main gown.

8. A surgical gown as set forth in claim 6, wherein said sleeves are each folded in at said lateral sides of said main gown and out at an intermediate location thereof back toward said lateral sides.

9. A method of folding a surgical gown having a main gown to which respective left and right sleeves are attached, said method comprising steps of:

(a) folding left and right flaps of said main gown at least partially back upon themselves to expose an interior surface of said main gown;

(b) folding said left and right sleeves behind a back portion of said main gown;

(c) folding said main gown back along first and second longitudinal fold lines extending substantially parallel to respective lateral sides thereof;

(d) folding said main gown back along at least one transverse fold line extending substantially transverse to said lateral sides of said main gown to define left and right hand pockets after folding along said first and second longitudinal fold lines; and (e) folding said main gown along a third longitudinal fold line to form a folded surgical gown such that said left and right hand pockets are located on opposite sides thereof.

10. A method of folding a surgical gown as set forth in claim 9, wherein said main gown is folded in step (d) back along first and second transverse fold lines.

11. A method of folding a surgical gown as set forth in claim 10, wherein said main gown is further folded back along an initial transverse fold line before being folded along said first and second longitudinal fold lines.

12. A method of folding a surgical gown as set forth in claim 11, wherein said main gown is folded along said initial transverse fold line and first and second transverse fold lines to have a final longitudinal length less than approximately one-fourth an original longitudinal length of said main gown.

13. A method of folding a surgical gown as set forth in claim 11, wherein said sleeves are folded behind said back portion of said main gown before said main gown is folded along said initial transverse fold line.

14. A method of folding a surgical gown as set forth in claim 13, wherein said sleeves are folded behind said back portion of said main gown at an acute angle from a transverse dimension of said main gown.

15. A method of folding a surgical gown as set forth in claim 14, wherein said sleeves are each folded in at said lateral sides of said main gown to completely cross one another behind said back portion of said main gown.

16. A method of folding a surgical gown as set forth in claim 14, wherein said sleeves are each folded in at said lateral sides of said main gown and out at an intermediate location thereof back toward said lateral sides.

17. A method of folding a long-sleeved garment having a back portion and an opposed front portion defining left and right flaps, said method comprising steps of:

(a) folding said left and right flaps at least partially back upon themselves to expose an interior surface of said garment;

(b) folding left and right sleeves of said garment behind said back portion at an acute angle to a transverse dimension thereof;

(c) folding a selected length of said garment back along an initial transverse fold;

(d) folding said garment back along first and second longitudinal fold lines extending substantially parallel to respective lateral sides thereof; and (e) folding said garment back along two subsequent transverse fold lines extending substantially transverse to said lateral sides such that said garment has a longitudinal length less than approximately one-fourth an original longitudinal length thereof.

18. A method of folding a long-sleeved garment as set forth in claim 17, further comprising the step of folding said garment along a central longitudinal fold line to form a folded garment wherein left and right hand pockets are located on opposite sides thereof to facilitate donning of said garment by a wearer without touching an outer surface of said garment.

* * * * *